US006579443B1

(12) United States Patent
Iaccino et al.

(10) Patent No.: US 6,579,443 B1
(45) **Date of Patent: *Jun. 17, 2003**

(54) COUNTERCURRENT HYDROPROCESSING WITH TREATMENT OF FEEDSTREAM TO REMOVE PARTICULATES AND FOULANT PRECURSORS

(75) Inventors: Larry L. Iaccino, Friendswood, TX (US); Edward S. Ellis, Basking Ridge, NJ (US); Ramesh Gupta, Berkeley Heights, NJ (US); Brenda A. Raich, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/456,139

(22) Filed: Dec. 7, 1999

Related U.S. Application Data

(60) Provisional application No. 60/111,178, filed on Dec. 7, 1998.

(51) Int. Cl.[7] ..... C10G 45/00

(52) U.S. Cl. ..... 208/212; 208/99; 208/108; 208/209; 208/254 H; 208/264; 208/48 R

(58) Field of Search ..... 208/48 R, 48 AA, 208/131, 132, 208 R, 251 H, 254 R, 99, 108, 264, 145, 209, 212; 585/648

(56) References Cited

U.S. PATENT DOCUMENTS

| | | | | |
|---|---|---|---|---|
| 2,952,626 A | | 9/1960 | Kelley et al. | 208/210 |
| 2,971,754 A | | 2/1961 | Seyfried | 266/5 |
| 2,987,467 A | | 6/1961 | Keith et al. | 208/97 |
| 3,017,345 A | | 1/1962 | Eastman et al. | 208/210 |
| 3,091,586 A | | 5/1963 | Pappas et al. | 208/210 |
| 3,124,526 A | | 3/1964 | Butler et al. | 208/264 |
| 3,147,210 A | | 9/1964 | Hass et al. | 208/210 |
| 3,211,641 A | | 10/1965 | Halik et al. | 208/59 |
| 3,228,871 A | | 1/1966 | Schlinger et al. | 208/58 |
| 3,268,438 A | | 8/1966 | Scott, Jr. et al. | 208/89 |
| 3,413,216 A | | 11/1968 | Doumani | 208/216 |
| 3,415,737 A | | 12/1968 | Kluksdahl | 208/139 |
| 3,425,810 A | | 2/1969 | Scott, Jr. | 23/289 |
| 3,450,784 A | | 6/1969 | Reilly et al. | 260/667 |
| 3,461,063 A | | 8/1969 | Stine et al. | 208/143 |
| 3,595,779 A | | 7/1971 | Peck et al. | 208/210 |
| 3,607,723 A | | 9/1971 | Peck et al. | 208/59 |
| 3,658,681 A | | 4/1972 | Wilson et al. | 208/211 |
| 3,671,420 A | | 6/1972 | Wilson et al. | 208/61 |
| 3,673,078 A | | 6/1972 | Kirk, Jr. | 208/89 |
| 3,714,030 A | | 1/1973 | Winsor et al. | 208/210 |
| 3,767,562 A | | 10/1973 | Sze et al. | 208/57 |
| 3,775,291 A | | 11/1973 | Sze | 208/57 |
| 3,788,976 A | | 1/1974 | Kirk, Jr. | 208/89 |
| 3,843,508 A | | 10/1974 | Wilson et al. | 208/89 |
| 3,846,278 A | | 11/1974 | Sze et al. | 208/57 |
| 3,897,329 A | | 7/1975 | Franz et al. | 208/210 |
| 3,905,893 A | | 9/1975 | Christman et al. | 208/210 |
| 3,910,834 A | * | 10/1975 | Anderson | 208/59 |
| 4,021,330 A | | 5/1977 | Satchell, Jr. | 208/89 |
| 4,022,682 A | | 5/1977 | Bludis et al. | 208/89 |
| 4,026,674 A | | 5/1977 | McDonald | 23/283 |
| 4,194,964 A | | 3/1980 | Chen et al. | 208/108 |
| 4,212,726 A | | 7/1980 | Mayes | 208/101 |
| 4,213,847 A | | 7/1980 | Chen et al. | 208/111 |
| 4,243,519 A | | 1/1981 | Schorfheide | 208/210 |
| 4,457,834 A | | 7/1984 | Caspers et al. | 208/143 |
| 4,476,069 A | | 10/1984 | Harper et al. | 261/97 |
| 4,526,757 A | | 7/1985 | Gupta | 422/106 |
| 4,591,426 A | | 5/1986 | Krasuk et al. | 208/96 |
| 4,599,162 A | | 7/1986 | Yen | 208/59 |
| 4,624,748 A | | 11/1986 | Haunschild | 203/29 |
| 4,755,281 A | | 7/1988 | Penick | 208/108 |
| 4,801,373 A | | 1/1989 | Corman et al. | 208/210 |
| 4,952,306 A | | 8/1990 | Sawyer et al. | 208/216 |
| 4,968,409 A | * | 11/1990 | Smith | 208/157 |
| 5,026,459 A | | 6/1991 | Quang et al. | 202/158 |
| 5,082,551 A | | 1/1992 | Reynolds et al. | 208/100 |
| 5,183,556 A | | 2/1993 | Reilly et al. | 208/57 |
| 5,252,198 A | | 10/1993 | Harrison et al. | 208/208 R |
| 5,262,044 A | | 11/1993 | Huizinga et al. | 208/107 |
| 5,292,428 A | | 3/1994 | Harrison et al. | 208/208 R |
| 5,348,641 A | | 9/1994 | Shih | 208/89 |
| 5,366,614 A | | 11/1994 | Russ et al. | 208/65 |
| 5,378,348 A | | 1/1995 | Davis et al. | 208/27 |
| 5,449,501 A | | 9/1995 | Luebke et al. | 422/193 |
| 5,518,607 A | | 5/1996 | Field et al. | 208/212 |
| 5,522,198 A | | 6/1996 | Byer et al. | 52/741.3 |
| 5,522,983 A | | 6/1996 | Cash et al. | 208/59 |
| 5,670,116 A | | 9/1997 | Gupta et al. | 422/191 |
| 5,705,052 A | | 1/1998 | Gupta | 208/57 |
| 5,720,872 A | | 2/1998 | Gupta | 208/57 |
| 5,779,992 A | | 7/1998 | Higashi | 422/190 |
| 5,882,505 A | | 3/1999 | Wittenbrink et al. | 208/59 |
| 5,888,376 A | | 3/1999 | Wittenbrink et al. | 208/59 |
| 5,888,377 A | | 3/1999 | Bertram | 208/59 |
| 5,906,728 A | | 5/1999 | Iaccino et al. | 208/61 |
| 5,925,235 A | | 7/1999 | Habib | 208/111.35 |
| 5,928,497 A | * | 7/1999 | Iaccino | 208/212 |
| 5,939,031 A | | 8/1999 | Ellis et al. | 422/191 |
| 5,942,197 A | | 8/1999 | Gupta et al. | 422/191 |
| 5,985,131 A | | 11/1999 | Gupta et al. | 208/57 |
| 6,007,787 A | * | 12/1999 | Gupta et al. | 422/191 |
| 6,121,333 A | * | 9/2000 | Clerici et al. | 518/715 |

FOREIGN PATENT DOCUMENTS

| | | | |
|---|---|---|---|
| DE | 2935191 A1 | 4/1981 | C10G/45/00 |
| GB | 1323257 | 7/1973 | C10G/13/24 |
| RU | 2016617 | 7/1994 | B01D/1/00 |

* cited by examiner

*Primary Examiner*—Bekir L. Yildirim
(74) *Attorney, Agent, or Firm*—Gerard J. Hughes; Jeremy J. Kliebert

(57) ABSTRACT

A process for upgrading a liquid petroleum or chemical stream wherein said feedstream flows countercurrent to the flow of a treat gas, such as a hydrogen-containing gas, in at least one reaction zone. The feedstream is treated so that it is substantially free of particulate matter and foulant precursors.

12 Claims, No Drawings

COUNTERCURRENT HYDROPROCESSING WITH TREATMENT OF FEEDSTREAM TO REMOVE PARTICULATES AND FOULANT PRECURSORS

This application claims the benefit of provisional application No. 60/111,178 filed Dec. 7, 1998.

BACKGROUND OF THE DISCLOSURE

1. Field of the Invention

The present invention relates to a process for upgrading a liquid petroleum or chemical stream wherein said feedstream flows countercurrent to the flow of a treat gas, such as a hydrogen-containing gas, in at least one reaction zone. The feedstream treated so that it is substantially free of particulate matter and foulant precursors.

2. Background of the Invention

There is a continuing need in the petroleum refining and chemical industries for catalyst and process technology that result in increase yields of desirable products and lower yields of undesirable components, especially those related to environmental concerns. One such process technology, hydroprocessing, has been subjected to increasing demands for improved heteroatom removal, aromatic saturation, and boiling point reduction. More active catalysts and improved reaction vessel designs are needed to meet these demands. Countercurrent hydroprocessing, where the liquid feedstream flows counter to upflowing treat gas, has the potential of meeting some of these demands because they offer certain advantages over co-current process where the liquid feedstream and treat gas flow co-currently. Countercurrent hydroprocessing is well known, but it has never reached its commercial potential, primarily because of flooding problems.

A particulate containing feed, which would not cause noticeable fouling or operating difficulties when processed in a cocurrent flow reactor, was discovered to cause significant fouling of a countercurrent flow reactor. This fouling will cause the countercurrent flow reactor to be inoperable due to flooding. It is suspected that reactive species (i.e., dienes, peroxides, etc.) that could form polymeric material are the cause for fouling in a countercurrent reactor. Thus, it is highly desirable that particulates be removed from feedstreams that are to be processed in such reactors. The prior art does not address fouling and how to mitigate it when it happens. Therefore, there still exists a need for improved countercurrent hydroprocessing reactor designs.

SUMMARY OF THE INVENTION

In accordance with the present invention there is provided a process for hydroprocessing a hydrocarbonaceous feedstream, which process comprises:

a) treating said feedstream to remove particulates and/or foulant precursors;

b) introducing said treated feedstream into a reaction vessel upstream from at least one reaction zone and passing said feedstream through one or more reaction zones operated at hydroprocessing conditions, wherein each reaction zone contains a bed of hydroprocessing catalyst;

c) introducing a hydrogen-containing treat gas at the bottom of said reaction vessel and passing it upward through at least one reaction zone countercurrent to the flow of liquid feedstream, thereby reacting with said feedstream in the presence of said hydroprocessing catalysts and resulting in a liquid phase product stream and a vapor phase product stream;

d) passing the liquid phase product out of the bottom of said reaction vessels; and e) removing the vapor phase product stream overhead of said reaction zones.

In a preferred embodiment of the present invention said treating is done in contact with a hydrogen-containing treat gas in a reaction zone containing a catalyst which is effective for converting said foulant precursors to non foulant components.

In another preferred embodiment of the present invention the physical aspects of the catalyst are such that the catalyst bed physically filters the largest 10% of the particles present in the feedstream.

In yet another preferred embodiment of the present invention the filtration is achieved by a mechanical filtration means to remove the largest 10% of the particles.

DETAILED DESCRIPTION OF THE INVENTION

Non-limiting examples of hydroprocessing processes which can be practiced by the present invention include the hydroconversion of heavy petroleum feedstocks to lower boiling products; the hydrocracking of distillate boiling range feedstocks; the hydrotreating of various petroleum feedstocks to remove heteroatoms, such as sulfur, nitrogen, and oxygen; the hydrogenation of aromatics; the hydroisomerization and/or catalytic dewaxing of waxes, particularly Fischer-Tropsch waxes; and demetallation of heavy streams. It is preferred that the reaction vessels used in the practice of the present invention be those in which a hydrocarbon feedstock is hydrotreated and hydrogenated, more specifically when heteroatoms are removed and when at least a portion of the aromatic fraction of the feed is hydrogenated.

The practice of the present invention is applicable to all liquid-vapor countercurrent refinery and chemical processes. Feedstocks suitable for use in the practice of the present invention include those ranging from the naphtha boiling range to heavy feedstocks, such as gas oils and resids. Typically, the boiling range will be from about 40° C. to about 1000°C. Non-limiting examples of such heavy feedstocks include vacuum resid, atmospheric resid, vacuum gas oil (VGO), atmospheric gas oil (AGO), heavy atmospheric gas oil (HAGO), steam cracked gas oil (SCGO), deasphalted oil (DAO), and light cat cycle oil (LCCO).

The feedstocks of the present invention are subjected to countercurrent hydroprocessing in at least one catalyst bed, or reaction zone, wherein feedstock flows countercurrent to the flow of a hydrogen-containing treat gas. Typically, the hydroprocessing unit used in the practice of the present invention will be comprised of one or more reaction zones wherein each reaction zone contains a suitable catalyst for the intended reaction and wherein each reaction zone is immediately preceded and followed by a non-reaction zone where products can be removed and/or feed or treat gas introduced. The non-reaction zone will typically be a void (with respect to catalyst) horizontal cross section of the reaction vessel of suitable height, although it may contain inert packing material.

If the feedstock contains unacceptably high levels of heteroatoms, such as sulfur, nitrogen, or oxygen moieties, it can first be subjected to hydrotreating. In such cases, it is preferred that the first reaction zone be one in which the liquid feed stream flows co-current with a stream of hydrogen-containing treat gas through a fixed-bed of suitable hydrotreating catalyst. Of course the hydrotreating can be done in a separate reaction vessel. The term "hydrotreating" as used herein refers to processes wherein a hydrogen-containing treat gas is used in the presence of a catalyst which is primarily active for the removal of heteroatoms, including some metals removal, with some hydrogenation activity. When the feedstock is a Fischer-Tropsch reaction product stream, the most troublesome heteroatom species are the oxygenates.

Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Ni; and at least one Group VI metal, preferably Mo and W, more preferably Mo, on a high surface area support material, preferably alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same bed. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydroprocessing temperatures will be from about 100°C. to about 450° C. at pressures from about 50 psig to about 2,000 psig, or higher. If the feedstock contains relatively low levels of heteroatoms, then the co-current hydrotreating step can be eliminated and the feedstock can be passed directly to the hydroisomerization zone.

It will be understood that the treat-gas need not be pure hydrogen, but can be any suitable hydrogen-containing treat-gas. It is preferred that the countercurrent flowing hydrogen rich treat gas be cold make-up hydrogen-containing treat gas, preferably hydrogen. The countercurrent contacting of the liquid effluent with cold hydrogen-containing treat gas serves to affect a high hydrogen partial pressure and a cooler operating temperature, both of which are favorable for shifting chemical equilibrium towards saturated compounds. The liquid phase will typically be a mixture of the higher boiling components of the fresh feed. The vapor phase in the catalyst bed of the downstream reaction zone will be swept upward with the upflowing hydrogen-containing treat-gas and collected, fractionated, or passed along for further processing. It is preferred that the vapor phase effluent be removed from the non-reaction zone immediate upstream (relative to the flow of liquid effluent) of the countercurrent reaction zone.

Counter current flow reactors have been discovered to be more susceptible to fouling induced problems than a comparable cocurrent flow reactor. A particulate containing feed, which would not cause noticeable fouling or operating difficulties when processed in a cocurrent flow reactor will cause significant fouling of a countercurrent flow reactor. This fouling will cause the countercurrent flow reactor to be inoperable due to flooding. It is suspected that reactive species (i.e., dienes, peroxides, etc.) that could form polymeric material are the cause for fouling in a countercurrent reactor. Thus it is highly desirable that particulates be removed from feedstreams that are to be processed in such reactors.

The removal of particulates from feedstreams can accomplish in several ways. For example, a reactive filter can be used for the removal of both particulates and foulant precursors. An example of a reactive filter would be a very high LHSV cocurrent reactor (bulge in the line) with a very low TGR (~100 SCF/B or even just dissolved hydrogen) and relatively small catalyst to remove particulates by mechanical filtration (similar to a sand filter) and foulant precursors by reaction prior to putting feed into the countercurrent reactor. Two may be required in parallel to allow change out during operation. It may be desirable to put the reactive filter between multiple preheat exchangers to do diene hydrogenation on cracked stock before the temperature gets too high and begins to form polymer within the heat exchangers.

While the reactive filter may be operated in two phase flow, it is preferred that a single phase flow be used because the dynamics of filtration in a single phase flow are very different than the mechanism of filtration in two phase flow. For example, the pressure drop buildup in single phase flow is very slow compared to two phase flow, and also it is much easier to use a single phase filter as a deep bed filter (i.e., no cake or low cake formation) compared to a two phase filter. Using only soluble hydrogen is one way to keep the filter as single phase. One could also use a gas bypass pipe in the filter which becomes operative only when the filter pressure drop increases; this way the filter can start as a two phase filter and gradually becomes a single phase filter.

A less preferred method of practicing the present invention is to have discrete mechanical filtration (may be of any design familiar to those skilled in the art of filtration for the purpose of removal of particulates) coupled with a cocurrent reactor to remove foulant precursors. The two steps may be performed in either order, but mechanical filtration first is preferred.

If the vapor phase effluent still contains an undesirable level of heteroatoms, it can be passed to a vapor phase reaction zone containing additional hydrotreating catalyst and subjected to suitable hydrotreating conditions for further removal of the heteroatoms. It is to be understood that all reaction zones can either be in the same vessel separated by non-reaction zones, or any can be in separate vessels. The non-reaction zones in the later case will typically be the transfer lines leading from one vessel to another. It is also within the scope of the present invention that a feedstock which already contains adequately low levels of heteroatoms fed directly into a countercurrent hydroprocessing reaction zone. If a preprocessing step is performed to reduce the level of heteroatoms, the vapor and liquid are disengaged and the liquid effluent directed to the top of a countercurrent reactor. The vapor from the preprocessing step can be processed separately or combined with the vapor phase product from the countercurrent reactor. The vapor phase product(s) may undergo further vapor phase hydroprocessing if greater reduction in heteroatom and aromatic species is desired or sent directly to a recovery system. The catalyst may be contained in one or more beds in one vessel or multiple vessels. Various hardware, i.e., distributors, baffles, heat transfer devices, may be required inside the vessel(s) to provide proper temperature control and contacting (hydraulic regime) between the liquid, vapors, and catalyst. Also, cascading and liquid or gas quenching may also be used in the practice of the present, all of which are well known to those having ordinary skill in the art.

In another embodiment of the present invention, the feedstock can be introduced into a first reaction zone co-current to the flow of hydrogen-containing treat-gas. The vapor phase effluent fraction is separated from the liquid phase effluent fraction between reaction zones; that is, in a non-reaction zone. This separation between reaction zones is also referred to as catalytic distillation. The vapor phase effluent can be passed to additional hydrotreating, or collected, or further fractionated and sent to additional processing. The liquid phase effluent will then be passed to the next downstream reaction zone, which will preferably be a hydroisomerization countercurrent reaction zone. In other embodiments of the present invention, vapor or liquid phase effluent and/or treat gas can be withdrawn or injected between any reaction zones.

The countercurrent contacting of an effluent stream from an upstream reaction zone, with hydrogen-containing treat gas, strips dissolved heteroatom impurities from the effluent stream, thereby improving both the hydrogen partial pressure and the catalyst performance. That is, the catalyst may be on-stream for substantially longer periods of time before regeneration is required. Further, higher heteroatom removal levels will be achieved by the process of the present invention.

What is claimed is:

1. A process for hydroprocessing a hydrocarbonaceous feedstream, which process comprises:

a) treating said feedstream to remove particulates and/or foulant precursors;

b) introducing said treated feedstream into a reaction vessel upstream from at least one reaction zone and passing said feedstream through one or more reaction zones operated at hydroprocessing conditions, wherein each reaction zone contains a bed of hydroprocessing catalyst;

c) introducing a hydrogen-containing treat gas at the bottom of said reaction vessel and passing it upward through at least one reaction zone countercurrent to the flow of liquid feedstream, thereby reacting with said feedstream in the presence of said hydroprocessing catalysts and resulting in a liquid phase product stream and a vapor phase product stream;

d) passing the liquid phase product out of the bottom of said reaction vessels; and e) removing the vapor phase product stream overhead of said reaction zones.

2. The process of claim 1 wherein said treating is done in contact with a hydrogen-containing treat gas in a reaction zone containing a catalyst which is effective for converting said foulant precursors to non foulant components.

3. The process of claim 2 wherein the quantity of hydrogen-containing treat gas is such that it is completely dissolved in the liquid phase at the conditions in the reaction zone.

4. The process of claim 2 wherein the catalyst is a hydroprocessing catalyst.

5. The process of claim 2 wherein the physical aspects of the catalyst are such that the catalyst bed physically filters the largest 10% of the particles present in the feedstream.

6. The process of claim 1 wherein the filtration is achieved by a mechanical filtration means to remove the largest 10% of the particles.

7. The process of claim 2 wherein the hydrogen-containing treat gas is allowed to bypass at least a portion of the reaction zone through a bypass tube.

8. The process of claim 6 wherein the mechanical filtration is followed by a reactive step to remove foulant precursors.

9. The process of claim 1 wherein the hydrocarbonaceous feedstream is a heavy feedstock selected from the group consisting of vacuum resid, atmospheric resid, vacuum gas oil, atmospheric gas oil, heavy atmospheric gas oil, steam cracked gas oil, desaphalted oil, and light cat cycle oil.

10. The process of claim 1 wherein the hydrocarbonaceous feedstock is a naphtha boiling range feedstock.

11. The process of claim 1 wherein the feedstock is a Fischer-Tropsch reactor product stream.

12. The method of claim 1 wherein particulates are polymeric material and the foulant precursors are dienes, peroxides, or both.

* * * * *